US009765548B2

(12) United States Patent
Keller

(10) Patent No.: US 9,765,548 B2
(45) Date of Patent: Sep. 19, 2017

(54) SENTINEL EVENT REDUCING SAFETY KNOBS

(71) Applicant: Patrick E. Keller, Virginia Beach, VA (US)

(72) Inventor: Patrick E. Keller, Virginia Beach, VA (US)

( * ) Notice: Subject to any disclaimer, the term of this patent is extended or adjusted under 35 U.S.C. 154(b) by 159 days.

(21) Appl. No.: 14/291,425

(22) Filed: May 30, 2014

(65) Prior Publication Data

US 2014/0265375 A1 Sep. 18, 2014

Related U.S. Application Data

(63) Continuation of application No. 12/505,352, filed on Jul. 17, 2009, now Pat. No. 8,740,266.

(60) Provisional application No. 61/082,127, filed on Jul. 18, 2008.

(51) Int. Cl.
*E05B 3/00* (2006.01)
*E05B 1/00* (2006.01)

(52) U.S. Cl.
CPC ..... *E05B 1/0007* (2013.01); *E05B 1/0061* (2013.01); *Y10T 16/46* (2015.01); *Y10T 137/86823* (2015.04); *Y10T 292/57* (2015.04); *Y10T 292/82* (2015.04); *Y10T 292/85* (2015.04); *Y10T 292/861* (2015.04)

(58) Field of Classification Search
CPC ..... Y10T 137/0491; Y10T 137/6014; Y10T 137/86823; E03C 1/042; E03C 2201/50; E03C 1/00; E03C 1/021; E03C 1/0408; E03C 1/06
USPC ..... 292/336.3
See application file for complete search history.

(56) References Cited

U.S. PATENT DOCUMENTS 2,460,005 A * 1/1949 Gruen ..... A47K 5/02 137/359
4,313,350 A * 2/1982 Keller, III ..... F16K 11/165 251/285
D284,990 S * 8/1986 Ogilvie ..... D23/245
5,198,826 A 3/1993 Ito
6,830,193 B2 12/2004 Tanaka
6,971,143 B2 * 12/2005 Domroese ..... F04B 43/1253 16/441
7,023,391 B2 4/2006 Wuidart et al.
7,741,734 B2 6/2010 Joannopoulos et al.
(Continued)

FOREIGN PATENT DOCUMENTS

EP 1158603 A1 11/2001
JP 2004173293 A 6/2004
(Continued)

OTHER PUBLICATIONS

International Search Report and Written Opinion from PCT/US2009/051046, International Search Authority—European Patent Office—dated Oct. 16, 2009.

*Primary Examiner* — Mark Williams
(74) *Attorney, Agent, or Firm* — Sheppard, Mullin, Richter & Hampton LLP

(57) ABSTRACT

There is disclosed herein a suicide prevention door handle and shower handle wherein each is designed to eliminate any area or structure that could be used to hold a belt, piece of clothing or the like as an aid in committing suicide by hanging. In each case, the safety knob comprises a tapered rose member or faceplate along with a cylinder wedge assembly or handle.

3 Claims, 4 Drawing Sheets

(56) References Cited

U.S. PATENT DOCUMENTS

| | | | |
|---|---|---|---|
| 7,825,543 | B2 | 11/2010 | Karalis et al. |
| 7,899,425 | B2 | 3/2011 | Forster |
| 2002/0003498 | A1 | 1/2002 | Wuidart et al. |
| 2007/0024510 | A1 | 2/2007 | Ghabra et al. |

FOREIGN PATENT DOCUMENTS

| | | | |
|---|---|---|---|
| WO | 2007072381 | A3 | 6/2007 |
| WO | 2008094383 | A1 | 8/2008 |

* cited by examiner

SENTINEL EVENT REDUCING SAFETY KNOBS

CROSS REFERENCE TO RELATED APPLICATIONS

This application claims the benefit of provisional application Ser. No. 61/082,127, filed Jul. 18, 2008, which application is incorporated herein by reference, and is a continuation of application Ser. No. 12/505,352, filed Jul. 17, 2009, which is incorporated herein by reference. Application Ser. No. 13/452,131, filed Apr. 20, 2012, which is a divisional application of Ser. No. 12/505,352, is also a related application.

FIELD

The disclosed embodiments relate generally to safety knobs adapted to significantly reduce or eliminate the occurrence of sentinel events and more particularly, but not exclusively, to safety knobs having particular constructions that prevents the physical means for an individual to hang him/herself.

BACKGROUND

Medical facilities are aware that some of their patient population is at risk of committing suicide, specifically hanging, while being treated in the medical facility. These suicides, referred to in the industry as sentinel events, typically occur either in the bathroom or in the shower stall of the medical facility.

Public use bathrooms typically have bathroom stalls, including a bathroom door and doorknob. The bathroom doors can be used as a platform or location for holding a belt or a piece of clothing to aid in committing suicide by hanging. Various systems for reducing sentinel events have been proposed, such as the sentinel event reduction system set forth in U.S. Pat. No. 7,024,823 entitled Sentinel Event Reduction System, the disclosure of which is incorporated herein by reference in its entirety.

The bathroom doorknob can also be used as a platform or location for holding a belt or a piece of clothing to aid in committing suicide by hanging.

Every bathroom or unit in a medical facility cannot be watched at the same time without enormous staff resources. Therefore, bathrooms, and specifically bathroom doorknobs, provide an area of opportunity for a sentinel event for patients at risk for suicide. Shower knobs also can be a problem.

To date, the problems of sentinel events in bathrooms are typically addressed by removing all bathroom stall hardware, including doors and doorknobs. While this reduces opportunities for sentinel events, it likewise eliminates all privacy that a patient may have.

Figure 1:
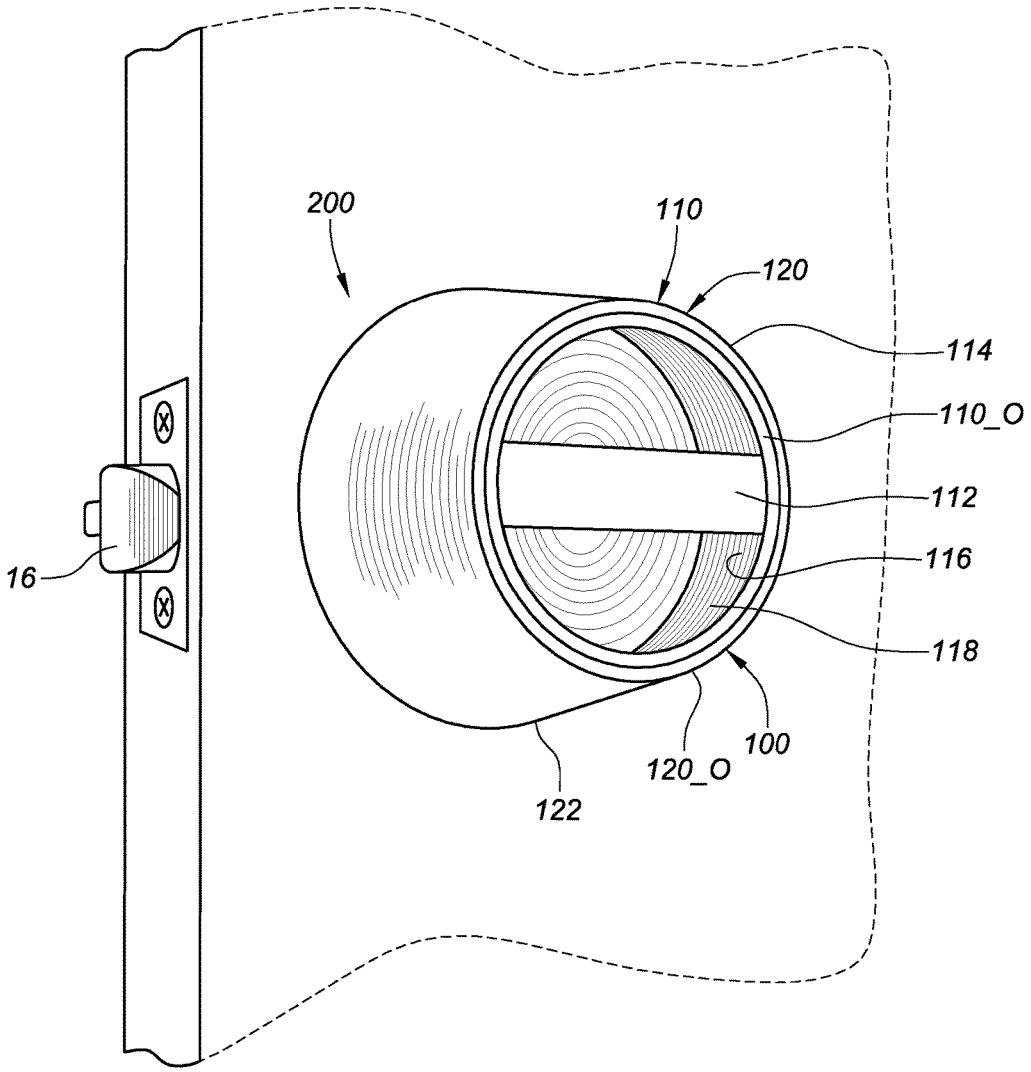
FIG. 1 illustrates an embodiment of a safety door knob, wherein the safety knob comprises a tapered rose member and a cylinder wedge assembly.

It should be noted that the Figures are not drawn to scale and that elements of similar structures or functions are generally represented by like reference numerals for illustrative purposes throughout the Figures. It also should be noted that the Figures are only intended to facilitate the description of the disclosed embodiments. The Figures do not illustrate every aspect of the disclosed embodiments and do not limit the scope of the disclosed embodiments.

DESCRIPTION OF THE PREFERRED EMBODIMENTS

A safety door knob 100 overcomes the foregoing drawbacks and addresses the problems described herein. The safety knob 100 described herein has been engineered so that any attempt to use it as a hanging platform will fail. Nothing can hang off the safety knob or be wedged within the safety knob without sliding or falling off because all foreseeable hanging points are removed. The sentinel event reducing safety knob includes a uniquely-engineered knob that prevents hanging of any material on the knob for use particularly in facilities where there are at risk patients who may attempt suicide, specifically by hanging.

The safety knob can be used in conjunction with any door that can be hung in any conventional door frame. It is encouraged that the safety knob be used in conjunction with the door described in the above-referenced U.S. Pat. No. 7,024,823.

Figure 2:
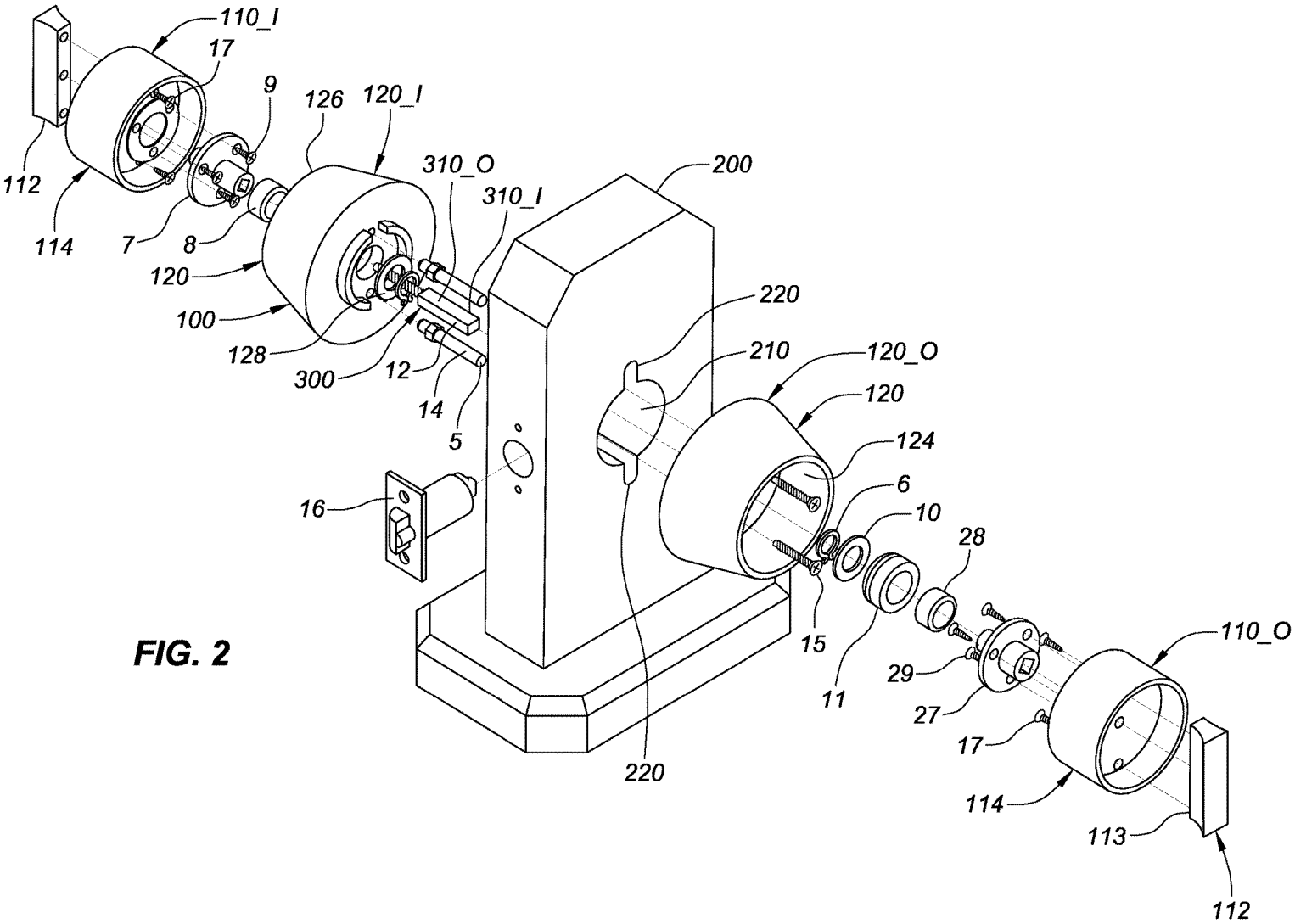
FIG. 2 is an exploded view of the safety knob of FIG. 1.

FIG. 1 illustrates a preferred embodiment of the sentinel event reducing safety knob 100. Turning to FIG. 1, the sentinel event reducing safety knob 100 is shown as including a cylinder wedge assembly 110, such as an outside cylinder wedge assembly 110_0, and a rose member 120, such as an outside rose 1200, suitable for installation at a mounting structure 200, such as a door. The outside rose 1200 has a tapered outer surface 122. The outside rose 120 0 also forms an internal chamber 124 (shown in FIG. 2) for receiving the outside cylinder wedge assembly 110 O. The outside cylinder wedge assembly 110_0 preferably includes a safety pull wedge 112 and a cylinder member 114, which can comprise separate units as shown in FIG. 2 or can be integrated into a single unit. If provided as separate units, the safety pull wedge 112 and cylinder member 114 can be coupled via one or more fasteners, such as a screw 17 (shown in FIG. 2). The cylinder member 114 includes an inner surface 116 that defines an internal opening 118 within the cylinder member 114. When the safety pull wedge 112 is disposed within the internal opening 118, an outer surface 113 (shown in FIG. 2) of the safety pull wedge 112 is flush with the inner surface 116 of the cylinder member 114, and, hence, no space is present on the safety knob 100 to operate as a hanging point. The safety knob 100 can be activated, such as by rotating and/or translating, to extend and/or retract a locking mechanism 16. Thereby, when the outside cylinder wedge assembly 110_0 is received within the outer rose 120 0, the safety knob 100 provides a knob surface that is not suitable for hanging.

FIG. 2 is an exploded view of the safety knob 100 of FIG. 1. As shown in FIG. 2, the safety knob 100 includes both the outer rose 120_0 and the outer cylinder wedge assembly 110_0 as well as an inner rose 120 I and an inner cylinder wedge assembly 110_I. The inner rose 120_1 can be provided in the same manner as the outside rose 120 0 described above with reference to FIG. 1. The inner rose 120_1 includes an internal chamber 126 for receiving the inner cylinder wedge assembly 110_I. The inner cylinder wedge assembly 110_I preferably is provided in the manner set forth above with reference to the outer cylinder wedge assembly 110_0 in FIG. 1.

Safety knob 100 can be used with any conventional latching mechanism 16. An illustrative latching mechanism is shown in FIG. 2. The latching mechanism 16 is disposed within the mounting structure 200 and can be activated by the safety knob 100 via conventional hardware 300. The conventional hardware 300 can be installed within an opening 210 formed by the mounting structure 200. The hardware 300 can be disposed within and extend through the opening 210 and includes an outside end region 310 0 for coupling with the outside cylinder wedge assembly 110_0 and an inside end region 310_1 for coupling with the inside cylinder wedge assembly 110 I.

The outside end region 310 0 of the hardware 300 can pass through an opening (not shown) formed within the outside rose 120_0 and communicating with the internal chamber 124. Extending within the internal chamber 124, the outside end region 310 0 can couple with the outside cylinder wedge assembly 110 O. Similarly, the inside end region 310 I of the hardware 300 can pass through an opening 128 formed within the inner rose 120_1 and communicating with the internal chamber 126. Extending within the internal chamber 126, the inside end region 310 I can couple with the inside cylinder wedge assembly 110 I.

The inside cylinder wedge assembly 110 I and the outside cylinder wedge assembly 110_0 each thereby communicate with the hardware 300 and can be activated, such as by rotating and/or translating, to extend and/or retract the locking mechanism 16.

The inside cylinder wedge assembly 110 I attaches to the inside end region 310 I. The inside end region 310_I can include an inside knob bushing 7 and an inside needle roller bearing 8, and can be coupled with the inside cylinder wedge assembly 110 I via one or more fasteners 9. Similarly, the outside cylinder wedge assembly 110_0 attaches to the outside end region 310_0. The outside end region 310_0 can include an outside knob bushing 27 and a outside needle roller bearing 28, and can be coupled with the outside cylinder wedge assembly 110_0 via one or more fasteners 29.

A spindle 12 passes through the opening 210, interacting with the latching mechanism 16, extends into the internal chamber 124 of the outer rose 120_0, and mates with the outside knob bushing 27. Posts 14 include an internally threaded region 5 for receiving screws 15. The posts 14 are respectively received within channels 220 formed within the opening 210 and maintain the orientation of the safety knob 100.

Figure 3A:
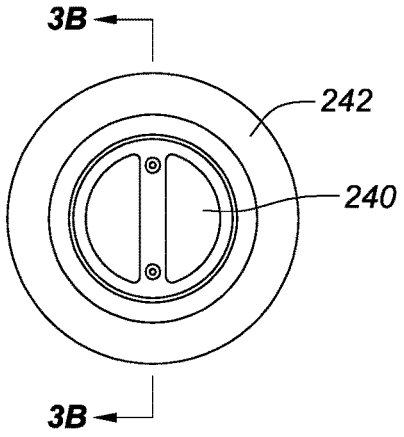
FIGS. 3A and 3B illustrate an embodiment of a safety shower valve knob.
Figure 3B:
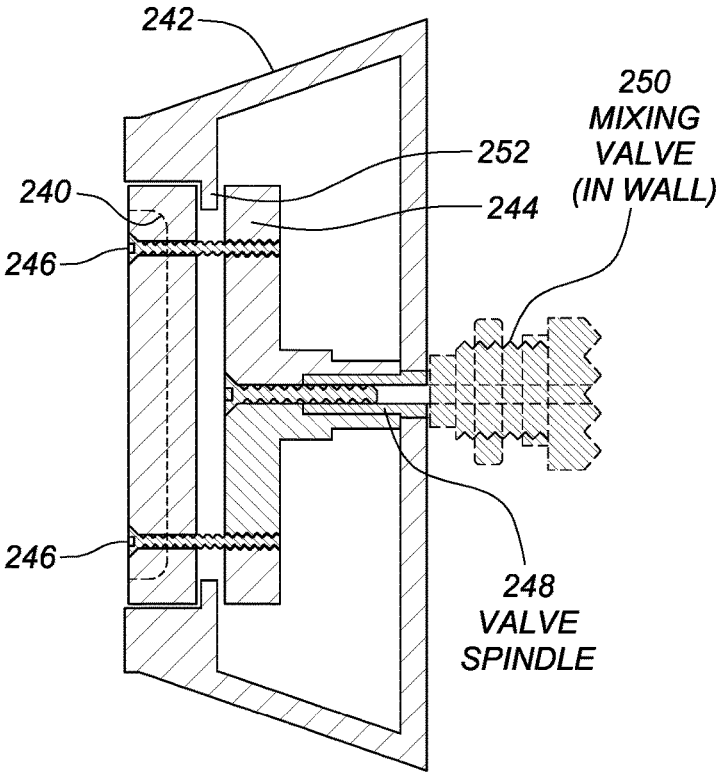
Figure 4A:
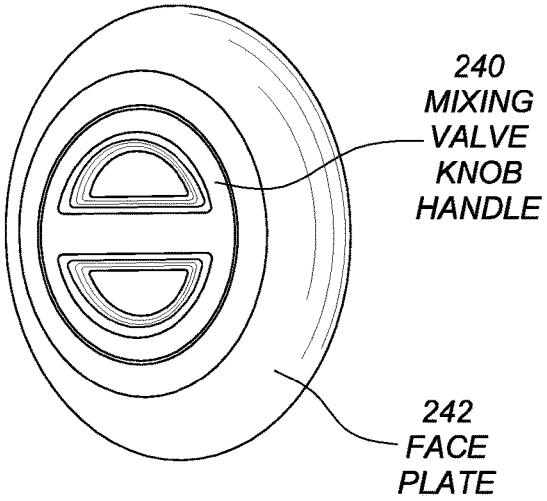
FIGS. 4A, 4B, and 4C illustrate the basic components of the shower valve knob.
Figure 4B:
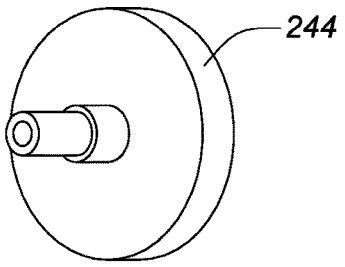
Figure 4C:
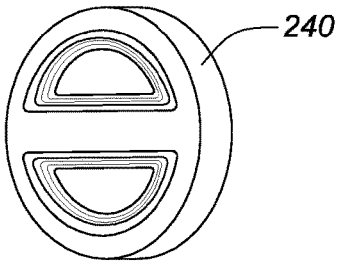

Turning now to FIGS. 3 and 4, a safety shower valve handle 240 is shown as a mixing valve handle recessed in a beveled faceplate 242. The mixing valve handle 240 is connected to a control knob 244 by suitable screws 246. The control knob is threaded onto the valve spindle 248 of the water mixing valve 250 which is within the shower wall.

Thus, this suicide prevention shower handle can replace any non-push type shower handle and faceplate. It preferably is made of high impact Corian material which will not rust nor corrode. The handle 240 and control knob 244 are securely bolted together with the lip 252 of the faceplate 242 between them as seen in FIG. 3*b*. This design prevents the handle from either being pulled apart or pushed in by a patient. It also prevents anything from being slipped behind the handle and used as a hanging point.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

The invention claimed is:

1. A safety knob device adapted to activate a shower valve, said safety knob device comprising:

a tubular faceplate comprising a housing adapted to be coupled to a shower valve, said faceplate having a tapered outer surface having an open small diameter end, a rotatable valve handle having an outer diameter surface which substantially fills said small diameter end, an inner surface of the rotatable valve handle and an interior space of the tubular face plate forming an internal chamber, wherein said rotatable valve handle has an external cavity therein, and a gripping member located in said cavity, a valve control member located in said internal chamber and adapted to be coupled to a shower valve, and an internal lip located between said valve handle and said valve control member, said internal lip adapted to provide an abutment surface to at least part of the inner surface of the rotatable valve handle;

wherein said safety knob device is arranged in form and shape such that it does not have a surface or point capable of being used as a hanging surface or hanging point.

2. A safety shower valve control device comprising:

a tubular outer body having a proximal end adapted to abut the surface of a shower wall, said outer body having an open distal end, said outer body having a tapered surface extending from said proximal end to said distal end and said distal end having a smaller diameter than said proximal end a rotatable valve handle having an outer diameter surface which substantially fills the open distal end, an inner surface of the rotatable valve handle and an interior space of the outer body forming an internal chamber;

wherein said rotatable valve handle has an external cavity therein, and a gripping member located in said cavity, a valve control member located in said internal chamber and adapted to be coupled to a shower valve, and an internal lip on the interior surface of said outer body extending into said internal chamber, said lip being located between said rotatable valve handle and said valve control member and said rotatable valve handle being coupled to said valve control member, said internal lip adapted to provide an abutment surface to at least part of the inner surface of the rotatable valve handle;

wherein said safety shower control device is arranged in form and shape such that it does not have a surface or point capable of being used as a hanging surface or hanging point.

3. A safety shower valve control device comprising:

a tubular outer member adapted to abut a shower wall, the outer member having a tapered external surface and having an open small diameter end, a rotatable valve handle member having an outer diameter surface which substantially fills said small diameter end, an inner surface of the rotatable valve handle and an interior space of the tubular outer member forming an internal chamber, said rotatable valve handle adapted to control a shower valve via a valve control member, said valve control member being located in said internal chamber, said valve control member is adapted to be coupled to a shower valve, said rotatable handle member having an external cavity therein, and a gripping member on said handle member, the gripping member located in said external cavity, wherein the outer member is adapted to abut a shower wall, and the configuration of the tapered external surface, rotatable handle member, and gripping member is such that said control device does not have a surface or point capable of being used as a hanging surface or hanging point.

* * * * *